US005324014A

United States Patent [19]

Honegger et al.

[11] Patent Number: 5,324,014

[45] Date of Patent: Jun. 28, 1994

[54] PROCESS AND APPARATUS FOR PROCESSING PRINTING PRODUCTS

[75] Inventors: Werner Honegger, Tann Ruti; Egon Hansch, Wetzikon, both of Switzerland

[73] Assignee: Ferag AG, Hinwil, Switzerland

[21] Appl. No.: 997,856

[22] Filed: Dec. 29, 1992

[30] Foreign Application Priority Data

Jan. 10, 1992 [CH] Switzerland ..... 00060/92-6

[51] Int. Cl.[5] ..... B65H 5/30; B65H 29/20

[52] U.S. Cl. ..... 270/55; 271/271; 271/315

[58] Field of Search ..... 270/54, 55, 58; 271/175, 182, 187, 184, 225, 271, 275, 279, 315

[56] References Cited

U.S. PATENT DOCUMENTS 3,951,399 4/1976 Reist ..... 270/58
4,058,202 11/1977 Reist et al. ..... 270/55 X
4,408,754 10/1983 Meier .
4,408,755 10/1983 Meier .
4,416,448 11/1983 Meier ..... 270/55
4,684,116 8/1987 Hänsch ..... 270/54
4,706,951 11/1987 Leu .
4,709,910 12/1987 Honegger .
4,729,554 3/1988 Honegger .
4,735,406 4/1988 Weber .
4,898,336 2/1990 Reist .
4,981,291 1/1991 Honegger et al. ..... 270/55
4,995,563 2/1991 Kälin .
5,042,792 8/1991 Honegger et al. .
5,052,666 10/1991 Hänsch ..... 270/55
5,052,667 10/1991 Hänsch ..... 270/55
5,137,409 8/1992 Honegger ..... 270/55 X

*Primary Examiner*—Edward K. Look
*Assistant Examiner*—John Ryznic
*Attorney, Agent, or Firm*—McCormick, Paulding & Huber

[57] ABSTRACT

The processing drum, rotatable about the axis for processing printing products, has advancing means for the step-by-step advancing of the printing products deposited in a straddling manner on the rests. In the upper region of the circulating path, these advancing means perform a working stroke about the axis and in the lower region a return stroke. The processing drum has a drawing member reaching around it from below, on which drawing member holding members are arranged at the spacing (A) of the rests, in order to prevent the printing products from falling down when they pass through the lower part of the circulating path and at the same time to support the elongate processing drum.

18 Claims, 10 Drawing Sheets

BEST AVAILABLE COPY

PROCESS AND APPARATUS FOR PROCESSING PRINTING PRODUCTS

BACKGROUND OF THE INVENTION

The present invention relates to a process and an apparatus for processing printing products.

A process and an apparatus of this type are known from EP-A-0,341,425 and, respectively, the corresponding US-A-5,052,667. An apparatus for collecting printing products has a processing drum which is driven rotationally about its axis and has radial wall elements, on which saddle-shaped rests running parallel to the axis are arranged in the radially outer end regions. Provided in each receiving part, bounded in each case by two neighboring wall elements, are controllable clamping arrangements which are displaceable in the direction of the axis. In successive feed sections of the processing drum, printing products are deposited in a straddling manner on the rests or on printing products already deposited on said rests. The two printing product parts each reaching into a receiving part on both sides of the rest are held firmly clamped by the clamping arrangements concerned during passing through of the lower part of the circulating path and are fed in the axial direction to the next-following section. The clamping arrangements consequently at the same time prevent the printing products from falling off the processing drum. In the upper region of the circulating path, in which the printing products rest on the rests by their own weight, the clamping arrangements are released and are pushed back into the original position by a return stroke. In the case of this known embodiment, consequently the entire lower part of the circulating path is utilized for the axial transport of the printing products by one step in each case and the printing products are not conveyed in the upper region of the circulating path. The product parts that extend reaching into a receiving part and are portions of the printing products deposited on neighboring rests are in each case firmly held in common by a clamping arrangement.

On the basis of this prior art, it is an object of the present invention to develop the known process further in such a way that the apparatus serving to carry out the process is as simple as possible, variable and flexible in application, and the processing drum can be constructed with a small diameter.

SUMMARY OF THE INVENTION

The present invention resides in a process and apparatus for processing printing products which preferably are folded printing products.

The apparatus, which carries out the process, has a processing drum driven rotationally about a horizontal axis, and a plurality of saddle-shaped rests are distributed regularly about the drum in the circumferential direction. The rests extend parallel to the horizontal axis and are arranged on radial wall elements.

The drum has at least one feed section in which the folded printing products can be deposited in a straddling manner on the rests. A removal section is offset with respect to the feeding section in the direction of the axis and is where the processed printing products are carried away from the processing drum.

Transport means transport the printing products step-by-step from the feed section to the removal section and include means for performing a work stroke in the direction from the feed section toward the removal section during one portion of a revolution of the processing drum and a return stroke in the opposite direction during another portion of the rotation.

The transport means is formed by advancing means which act on the printing products exclusively in a pushing manner and, viewed in the direction of the working stroke, push on the trailing edges of the products. Underneath the processing drum endless holding means reach around the processing drum and run synchronously with the saddle-shaped rests to prevent the printing products on the rests from falling off the processing drum while the rests are directed essentially downward.

Since, according to the invention, the transport means push the printing products, they can be of a very simple construction since they do not have to perform any clamping or holding action. The printing products are prevented from falling off the processing drum by holding means which are not arranged on the processing drum itself but are separate from it. The processing drum consequently has a minimum of moving parts, can be designed to be extremely simple and compact in construction and has a high reliability. Due to the fact that, when passing through the lower part of the circulating path, the printing products are stationary about the axis with respect to the rests, i.e. in the axial direction, at least in that section in which they are directed with their fold or the rests essentially downward and only move along with the rests in the circumferential direction, to benefit the simple construction of the processing drum it is deliberately accepted that the time available during one revolution is utilized completely for the transport or processing of the printing products. This is compensated, however, by the high reliability, the low servicing and adjusting work and small space requirement. Due to the fact that at least part of the advancement of the printing products takes place in the upper part of the circulating path, regions of the circulating path which are scarcely available for processing the printing products in the case of known apparatuses as well on account of the space requirements of the processing station and the necessary free accessibility are utilized for transporting the printing products. The present invention at the same time offers the possibility of the printing products stopping in the axial direction at the point where the printing products are deposited in a collecting manner one on top of the other. This simplifies the synchronization between the feed stations for the printing products and the processing drum and allows a mutually aligned depositing of the printing products one on top of the other.

In the case of a one preferred embodiment, the flexibility and own weight of the printing products or their parts is utilized. In the case of this embodiment, the sliding cams or driving fillets are slidingly active in that region of the circulating path in which the product part reaching into the receiving part concerned bears by its own weight against the wall element and the sliding cams or driving fillets perform a return stroke in that region of the circulating path in which the product part concerned sags on account of its weight and its flexibility and is located away from the wall element. In this case, the sliding cams or driving fillets do not have to be withdrawn from the region of the receiving parts for the return stroke, which permits a particularly simple construction of the advancing means.

Another embodiment of the apparatus allows not only the collecting of printing products, but also their gathering, printing products being introduced as a whole into the receiving parts and coming to lie next to one another or next to product parts of the printing products deposited on the rests. In that region of the circulating path where the printing products are pushed in the axial direction, consequently all the printing products bear against the part of the carriage forming the wall or the bottom and are consequently forcibly taken along. During the return stroke of the carriage with the advancing means, the printing products are not taken along, since they either bear against the fixed wall of the neighboring wall element or against a corresponding product part and, on account of their properties, are reliably located away from the active region of the carriage.

In a particularly preferred embodiment of the apparatus the advancement of the printing products is performed essentially only during one quarter of a revolution, so that an appreciable time is available during which the printing products do not perform any movement with respect to their rests and are not in contact with the holding means.

In the case of another embodiment of the apparatus, the processing drum can be constructed with a particularly small diameter, since no space is required in the processing drum for the drive mechanism.

A particularly simple adapting and setting of the apparatus to differently formatted printing products is ensured in the case of another embodiment of the apparatus.

Since, according to the present invention, the printing products are not held in a clamping manner and consequently printing products deposited on neighboring rests are not held together by a clamping arrangement, the possibility is provided of stopping as desired the advancing means assigned to a rest during the course of one or more revolutions, so that it does not perform any conveying or return stroke. This permits for example allowance to be made for non-fed printing products, by the printing products deposited on a rest being moved past at least twice in the case of the same feed station, i.e. performing two revolutions in the same drum section.

In the case of a further preferred embodiment, the printing products are not pressed, or pressed only slightly, in the region of their fold between the rest and the holding means, which prevents any damage. The holding elements support the printing products also in the region adjoining the fold, which prevents spreading out beyond a desired extent.

In a particularly simple way, the desired distance between the rests and supporting elements can be maintained in the case of another embodiment. If in this case the drawing members connected to the supporting elements are designed to be essentially inflexible, the processing drum is supported, which allows the simple construction of processing drums which are long in the axial direction.

An embodiment of the apparatus according to the invention which requires extremely little space and avoids long, complicatedly routed supply conveyors is also described.

BRIEF DESCRIPTION OF THE DRAWINGS

The present invention is now described in more detail with reference to the purely diagrammatic drawing, in which.

DESCRIPTION OF THE PREFERRED EMBODIMENTS

Figure 1:
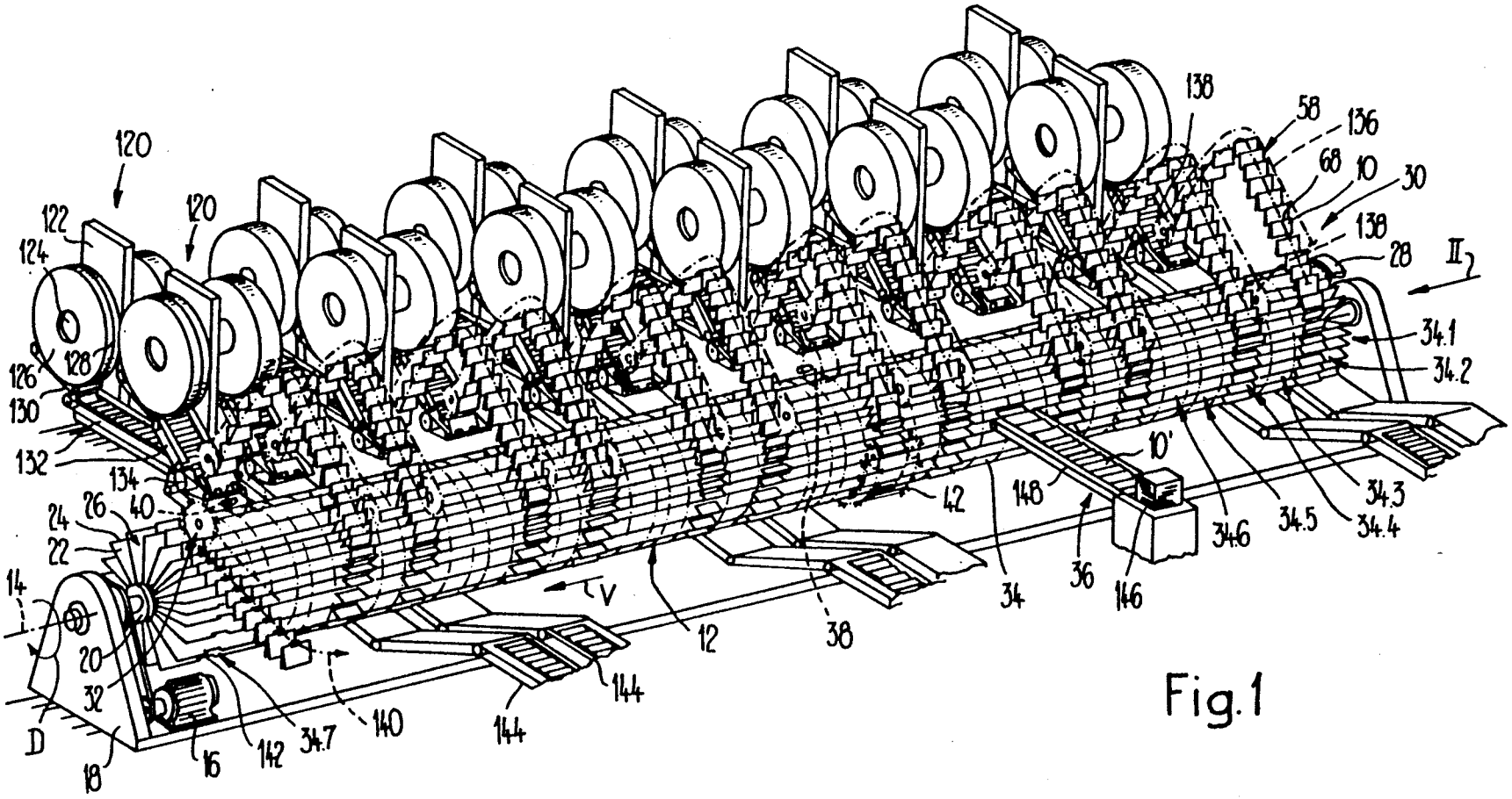
FIG. 1 shows the apparatus according to the invention perspectively and in some respects greatly simplified.

The apparatus shown in FIG. 1 for processing printing products 10 has an elongate processing drum 12, which is mounted rotatably about its horizontal axis 14 and is driven in the direction of rotation D by means of a drive motor 16. Fastened on the drum shaft 20, which is mounted rotatably on a machine frame 18 (shown simplified), are a multiplicity of wall elements 22, which are arranged approximately in axial planes, extend over the entire processing-active length of the processing drum 12 and are evenly distributed, seen in the circumferential direction. As still to be described in detail further below, the wall elements 22 have in their radial end regions saddle-shaped rests 24, which run parallel to the axis 14. In each case two neighboring wall elements 22 bound a pocket-shaped receiving part 26, into which advancing means (not visible in FIG. 1) project in order to advance the printing products 10 deposited in a straddling manner on the rests 24, or printing products 10' introduced into the receiving parts 26, step by step along the rests 24 or wall elements 22, respectively, in the direction of advancement V. During the course of one revolution of the processing drum 12, the advancing means in each case perform a working stroke in the direction of advancement V, under the control of a drive mechanism 28, and thereby take the printing products 10, 10' with them by one step, and a return stroke against the direction of advancement V, without thereby influencing the printing products 10, 10'.

Arranged next to one another along the processing drum 12 are twelve feed stations 30 and, seen in the direction of advancement V, these feed stations 30 are followed downstream by a removal station 32. The feed stations 30 described in more detail further below are designed for feeding folded printing products 10 in a known manner to the processing drum 12 and depositing them in a straddling manner on its rests 24 or on printing products 10 already deposited on said rests. Consequently, with the apparatus shown in FIG. 1 printing products 10 are collected. The removal station 32 is provided for the purpose of taking over and conveying away from the processing drum 12 printing products 10, 10, processed to form a finished product.

The processing drum 12 has in the axial direction directly successive drum sections 34 of the same width, this width being slightly smaller than a working stroke of the advancing means, but corresponding to a step by which the printing products 10, 10' are in each case advanced. The drive mechanism 28 is provided in the region of a first drum section, seen in the direction of advancement V, and designated by 34.1. In the direction of advancement V, the next-following adjacent drum section 34.2, also referred to as a feed station, is assigned a first feed station 30. In the next drum section 34.3, in the exemplary embodiment shown no processing of the printing products 10 fed in the second drum section 34.2 takes place, whereas the next drum section 34.4, again a feed section, is assigned a second feed station 30, by means of which further printing products 10 are deposited in a straddling manner on the printing products 10 already deposited on the rests 24. Between this second feed station 30 and the next-following feed station 30, seen in the direction of advancement V, there are two further drum sections 34, designated by 34.5 and 34.6, in which likewise no processing of the printing products 10 takes place. The drum sections 34, 34.3, 34.5, 34.6 situated between the feed sections 34, 34.2, 34.4 are indicated by in each case two dot-dashed lines, which indicate the position of the printing products 10 in these drum sections 34, 34.3, 34.5, 34.6. In corresponding sequence, the drum sections 34 following the drum section 34.6 are again assigned further feed stations 30, a point to note being that between two feed sections 34 in each case there is at least one drum section 34 which is not assigned a feed station 30. These latter drum sections 34 may be assigned different types of processing stations, as shown in FIG. 1 by way of a device 36 for introducing printing products 10' (supplements), a diagrammatically indicated device 38 for adhesively attaching supplements to the corresponding printing products 10 and a likewise diagrammatically indicated stitching device 40 for stitching together the collected printing products 10. It goes without saying that such processing stations may also be assigned to the drum sections 34.3, 34.5 and 34.6.

With the exception of the first drum section 34.1, which is assigned the drive mechanism 28, and the last drum section 34.7, seen in the direction of advancement V, which section is also referred to as the removal section and is assigned the removal station 32, each drum section 34 has holding means 42, which reach around the processing drum 12 from below approximately in the region of its lower half, in order on the one hand to prevent the printing products 10, 10' from falling off the rests 24 or falling out of the receiving parts 26 when they pass together with the rests 24 and receiving parts 26 through the lower half of the circulating path around the axis 14, and on the other hand to support the processing drum 12. For the sake of better clarity, only the holding means 42 in the region of a single drum section 34 are indicated in FIG. 1.

Figure 2:
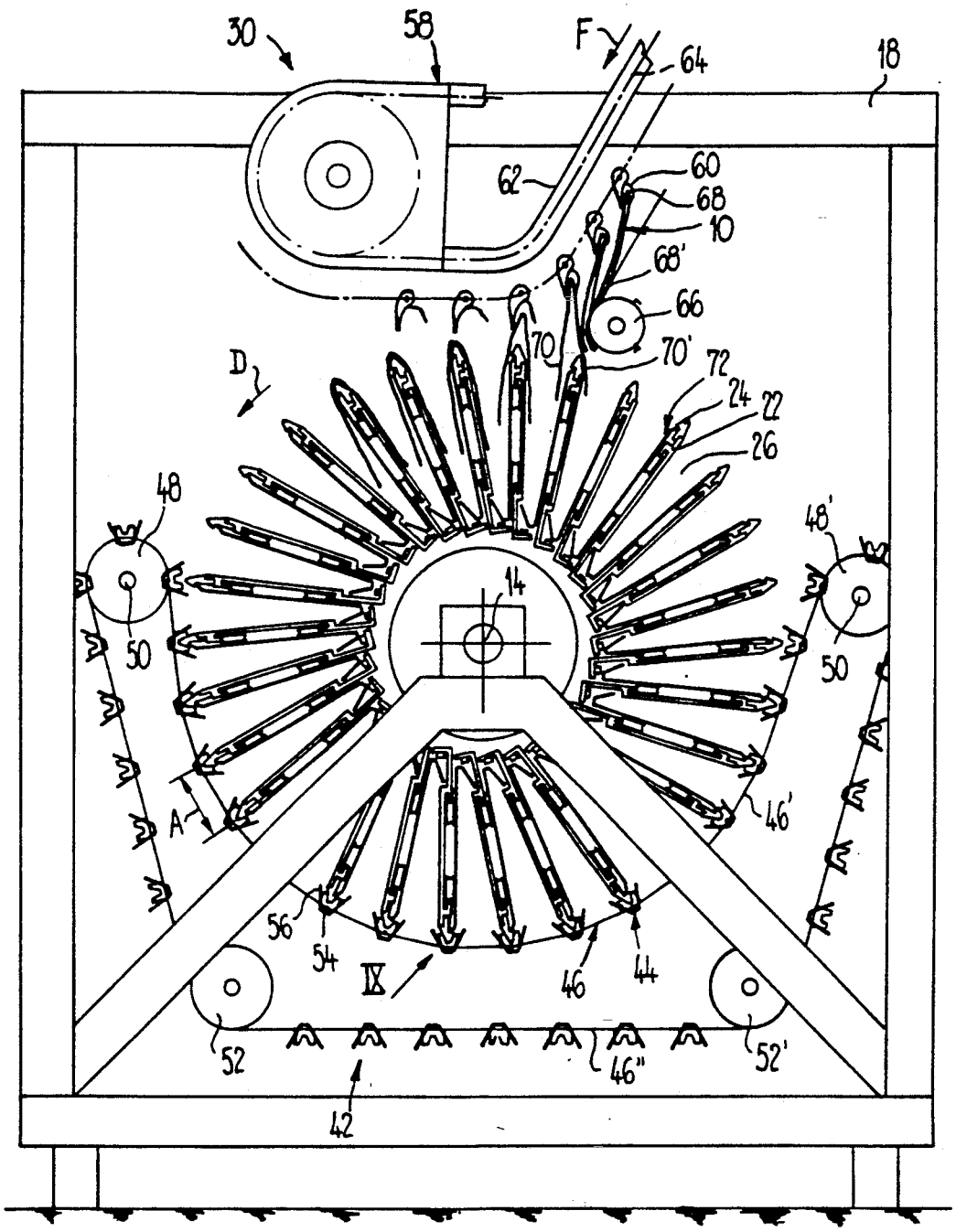
FIG. 2 shows a view in the direction of the arrow II of FIG. 1 of the processing drum of the apparatus with a supply conveyor.

As can be seen from FIG. 2, the holding means 42 have holding members 44 which are arranged at the spacing A, which corresponds to the spacing of the rests 24, on an endless drawing member 46. The drawing member 46 reaches with its upper active strand 46' around the processing drum 12 from below up to approximately the height of the axis 14. On both sides of the processing drum 12 and above the axis 14, the drawing member 46 is led around deflecting rollers 48, 48', which are mounted rotatably on rotary shafts 50, arranged on cantilever arms (not shown) on the machine frame 18 and axially parallel to the axis 14. Mounted freely rotatably, likewise on the machine frame 18, underneath the active strand 46' are two deflecting rollers 52, 52', around which the return strand 46'' of the drawing member 46 is lead. It goes without saying that the holding means 42 can also reach around the processing drum 12 from below by a smaller angle; at least, however, to the extent that the printing products 10, 10' are prevented from falling off the processing drum 12.

Each holding member 44 has at least one U-shaped or V-shaped supporting element 54, which in the active region of the holding means 42 comes into engagement in each case with the rest 24 concerned, in order on the one hand to drive the drawing member 46, and consequently the holding members 44, in a circulating manner synchronously with the processing drum 12 and on the other hand to support the processing drum 12. For this purpose, the drawing member 46 is designed to be essentially inflexible; suitable in particular for this purpose are chains, toothed belts and the like. Each holding member 44 has, furthermore, a holding element 56, which reaches around the rest 24 concerned at a distance and extends in the longitudinal direction of the processing drum 12, in each case approximately over one drum section 34.

FIG. 2 shows above the processing drum 12 a conveyor 58 of a feed station 30, which conveyor has in a known manner individually controllable grippers 60, which are arranged at fixed intervals one behind the other on a chain 64 which is indicated by dot-dashed lines and is guided in a cross-sectionally C-shaped rail 62. The chain 64 of the conveyor 58 is driven in a circulating manner in conveying direction F and its conveying speed corresponds approximately to the circulating speed of the rests 24 of the processing drum 12, and the mutual spacing of the grippers 60 likewise corresponds approximately to the spacing A between the rests 24. Seen in conveying direction F, the processing drum 12 has before it a generally known opening device 66, in order to open the printing products transported by the conveyor 58 with open side edge 68' ahead, said edge lying opposite the fold 68 of the printing products 10, so that in each case a rest 24 can enter between the printing product parts 70, 70' lifted off each other by the opening device 66. In this case, the printing product parts 70, 70' enter into the receiving parts 26 on both sides of the corresponding wall element 22. By opening the gripper 60, the corresponding printing product 10 then falls in a straddling manner onto the saddle-shaped rest 24. The feed station 30 consequently conveys to each rest 24 a printing product 10, which can of course comprise more than one sheet.

Figure 3:
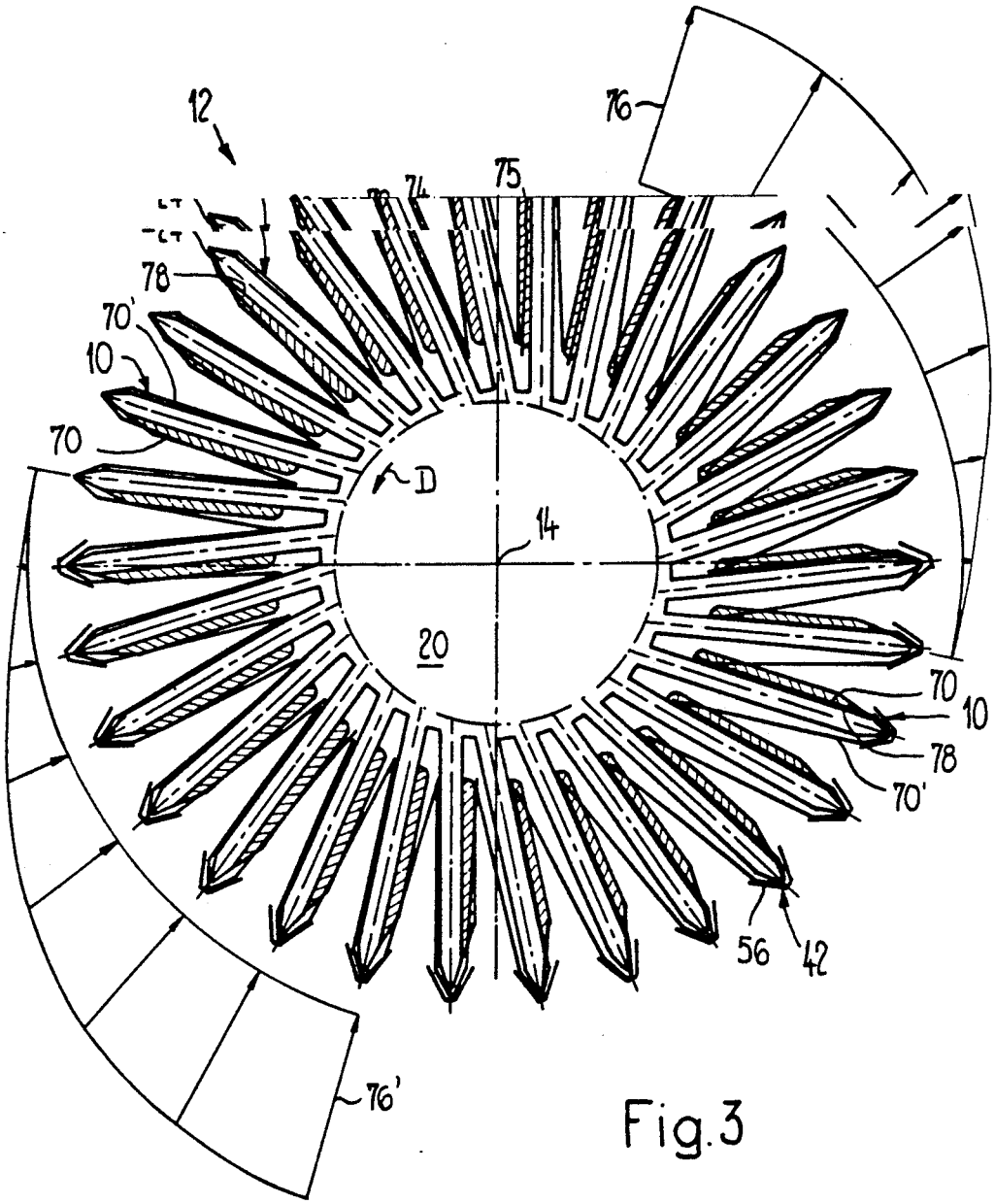
FIG. 3 shows, greatly simplified, the processing drum with diagrammatically indicated path of movement of the advancing means for advancing the printing products during the course of one revolution of the processing drum.

The advancing means 72 have sliding cams 75, which are assigned to each wall element 22, are designed as driving fillets 74 and are emphasized in FIG. 3 by hatching. These driving fillets 74 project beyond the wall elements 22, seen in the direction of rotation D, into the receiving part 26 respectively ahead of the wall element 22 and bounded by the latter. In this figure, the holding means 42 are indicated representatively only by the holding elements 56. The drive mechanism 28 controls the driving fillets 74, respectively assigned to a wall element 22, in such a way that, over the rotation of the processing drum 12 by about 90°, beginning approximately when the holding means 42 run off the processing drum, they perform a working stroke, the length of the arrows 76 symbolizing the stroke in the direction of advancement V in dependence on the rotational position of the processing drum 12. The working stroke thus takes place in that quadrant which, in the direction of rotation D, begins approximately at the height of the axis 14 and ends approximately vertically above the axis 14. In the then following quadrant, the driving fillets 74 maintain their position, and, beginning approximately at the height of the axis 14 to approximately vertically underneath the axis 14, the driving fillets 74 are activated to carry out a return stroke into the original position, as the arrows 76' symbolize; these symbolically show the return stroke as a function of the rotational position of the wall element 22 concerned.

In the region of the circulating path of the rests 24 situated to the right in FIG. 3 of a vertical plane through the axis 14, the printing product part 70 respectively ahead with respect to a rest 24 bears against the front wall 78 of the wall element 22 concerned, whereby the reliable taking-along of the printing products 10 by the driving fillets 74 is ensured. On the other hand, these printing product parts 70 sag in the region to the left of the said vertical plane, on account of their intrinsic flexibility, so that the driving fillets 74 can perform the return stroke without influencing the printing products 10. Consequently, from the end of the working stroke to the beginning of the next working stroke the printing products 10 maintain their position with respect to the rests 24 over approximately three quarters of a revolution of the processing drum 12. The effect of the bearing of the printing product part 70 against the front wall 78 of the wall element 22 concerned and the sagging of this printing product part 70 is further intensified in the regions situated to the right and left of the vertical plane through the axis 14 by the fact that the wall elements 22 are inclined slightly forward, seen in the direction of rotation D, with respect to axial planes running through them.

Figure 4:
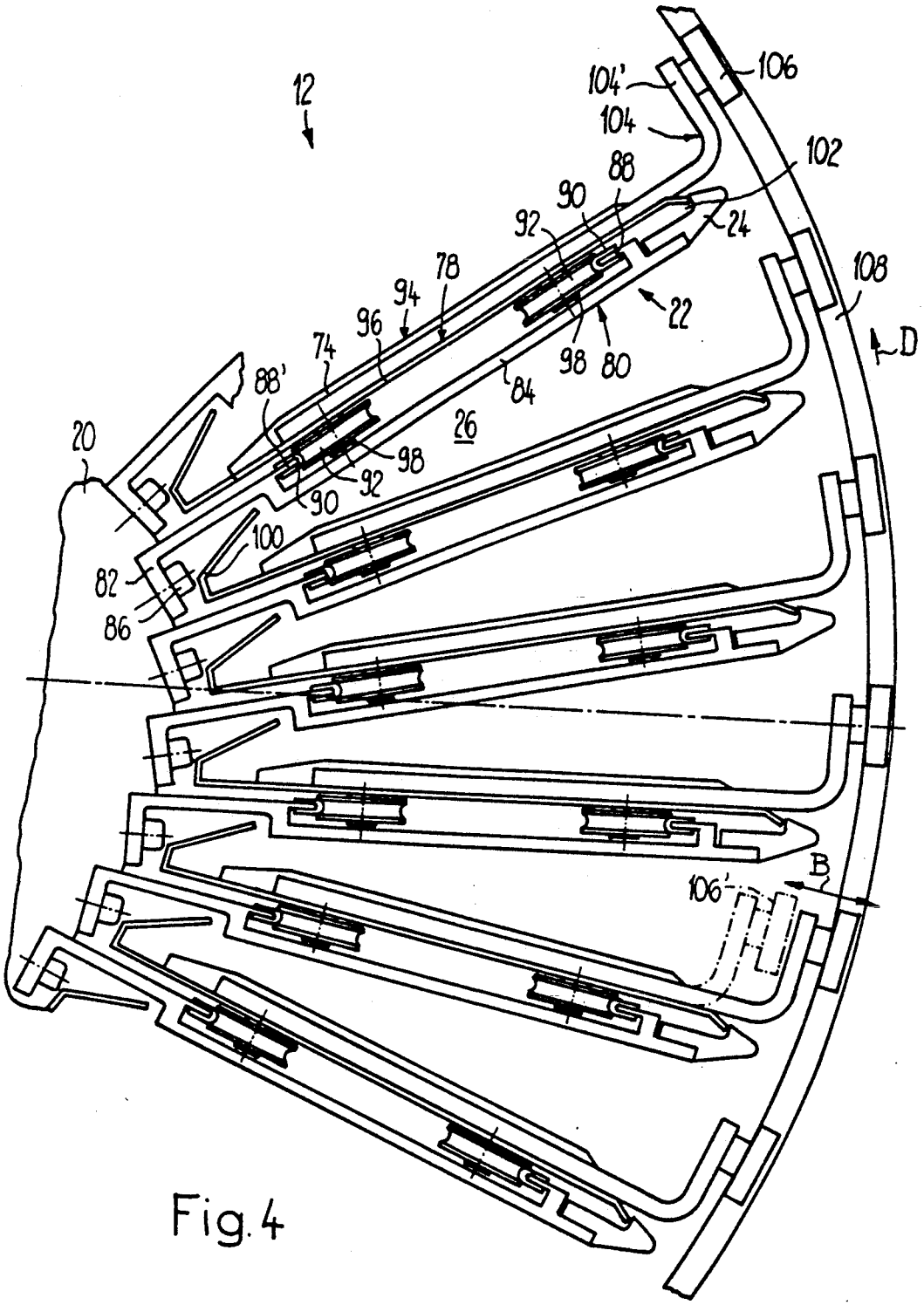
FIG. 4 shows, enlarged, a part of the processing drum.

The construction of the processing drum 12 is now explained in more detail with reference to FIGS. 4 and 5. The wall elements 22 have profile-like carrying elements 80 with a cross-sectionally L-shaped foot part 82 and a cross-sectionally approximately C-shaped guide part 84. The foot part 82 is passed through by fastening elements 86, preferably screws, in order to fasten the carrying element 80 on the drum shaft 20. Seen in the radial direction, outside the guide part 84 there is fastened on each carrying element 80 the corresponding, cross-sectionally approximately triangular rest 24. Seen in the direction of rotation D, the guide part 84 is forwardly open and its mutually facing flanks 88, 88, are embraced by U-shaped plastic profiles 90, on which wheels 92 with concave thread of a carriage 94 are guided. These wheels 92 are mounted freely rotatably on bearing bolts 98 which are fastened . on a metal sheet 96, forming the front wall 78 of the wall element 22, and protrude from said sheet. The end region of the metal sheet 96 facing the drum shaft 20 is bent in the manner of a channel, in order as bottom element 100 to bound the receiving part 26. The free end of this bottom element 100 extends under the carrying element 80 of the next wall element 22, in front when seen in direction of rotation D, in the region of the transition from the foot part 82 to the guide part 84. The outer end region of the metal sheet 96, seen in the radial direction, is bent off in order to extend under a corresponding recess 102 in the rest 24. On the side facing away from the carrying element 80, fixedly arranged on the metal sheet 96 at the spacing of one stroke are the driving fillets 74, so that they reach into the receiving part 26 ahead of a wall element 22. A carriage 94 extends over the entire processing-active length of the processing drum 12, it however being conceivable of course for this carriage to comprise a plurality of joined-together carriage parts.

At the end of the carriage 94 facing the drive mechanism 28, fastened on the metal sheet 96 is an angle lever 104 which, seen in the radial direction, projects beyond the rest 24 concerned and, on its outer part 104', running approximately in the tangential direction, bears a freely rotatably-mounted control roller 106. This control roller 106 is guided in a slotted-link arrangement 108 lead around the drum section 34.1, in order to move the carriages 94, and consequently the advancing means 92, in dependence on the rotational position of the wall element 102 concerned, as indicated in FIG. 3. A drive mechanism 28 of such a design allows the processing drum 12 to be constructed with a small diameter.

As indicated by the double-headed arrow B, the angle lever 104 may be arranged displaceably in the radial direction on the carriage 94, in order to withdraw the control roller 106, disengaged from the slotted-link arrangement 108, into a rest position 106' indicated by dot-dashed lines. The controlled engaging and disengaging of the control roller 106 permits the individual releasing of the advancing means 72 assigned to a rest 24 from the drive mechanism 28, for example for one revolution, and the subsequent reconnecting. With control roller 106 in rest position 106', no movement of the advancing means 72 assigned to the rest 24 concerned takes place in the direction of the axis 14 and consequently no axial conveyance of the corresponding printing products 10, 10' takes place either. If, for example, in a feed section 32.2, 34.4, there is mistakenly no printing product 10, 10', deposited onto a rest 24, this can be detected and the control roller 106 disengaged from the drive mechanism. The missing printing product 10, 10' can then be made up in the next cycle and the connection between the advancing means 72 concerned and the drive mechanism 28 can be reactivated.

Instead of the controlling of the angle lever 104, the drive mechanism 28 may also have a deflector arrangement, in order to make the control roller 106 concerned enter, if desired, into a secondary branch of the slotted-link control, which branch runs approximately in the circumferential direction.

Figure 5:
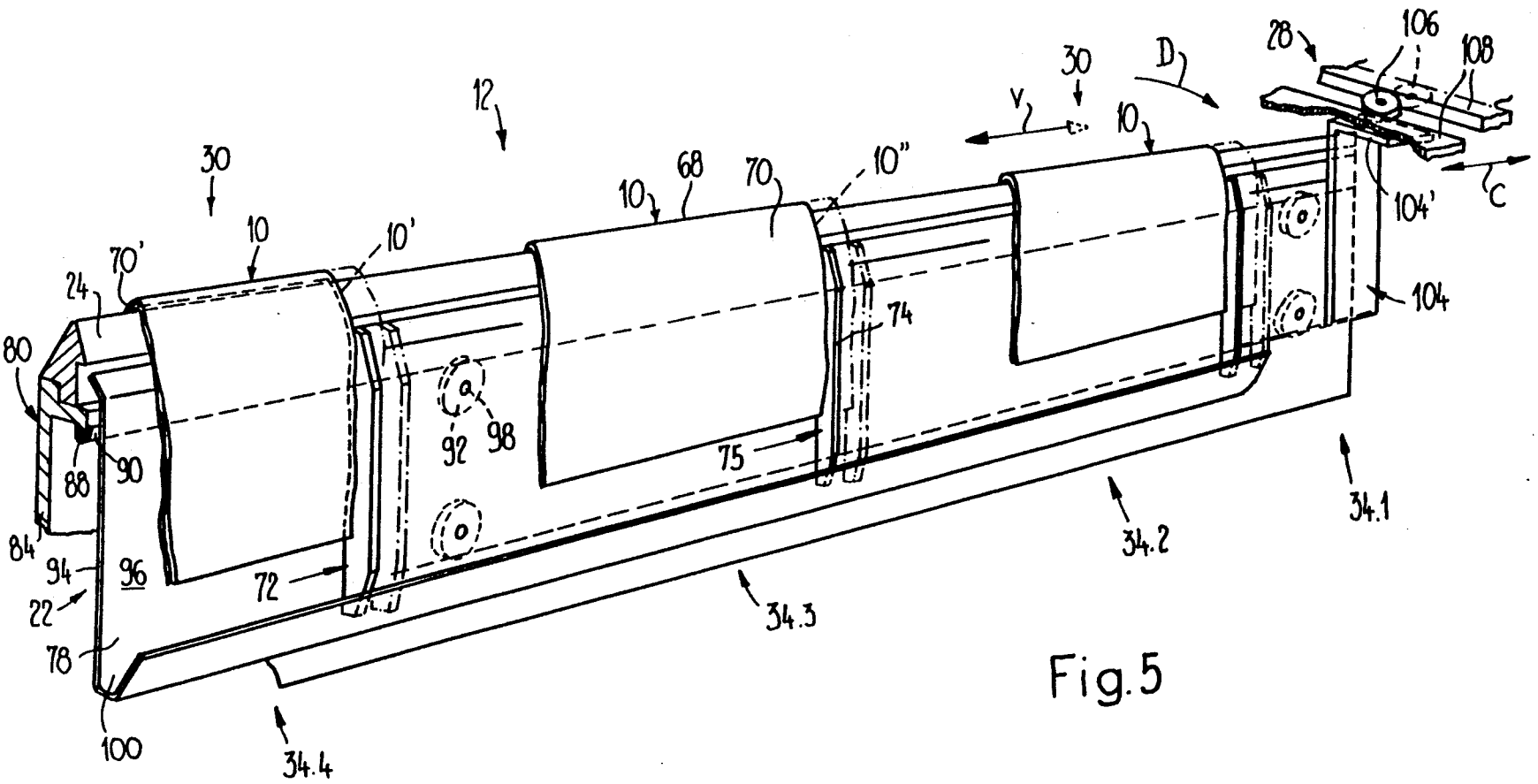
FIG. 5 shows in perspective representation a wall element of the processing drum with a saddle-shaped rest.

From FIG. 5 it can also be seen how the printing products 10, deposited on the rests 24 in a straddling manner, are advanced during a working stroke by driving fillets 74 at their trailing edge 10'', seen in the direction of advancement V. The return stroke of the advancing means 72 is indicated by the dashed arrow. As is indicated by the double-headed arrow C, the drive mechanism 28 can be displaced in the direction of the axis 14 and fixed at the desired point with respect to the machine frame 18. Consequently, the axial position of the carriage 94 with the driving fillets 74 also changes, as is indicated by dot-dashed lines. This provides a simple adaptation of the apparatus to printing products 10, 10' of different fold lengths which are to be processed.

Figure 6:
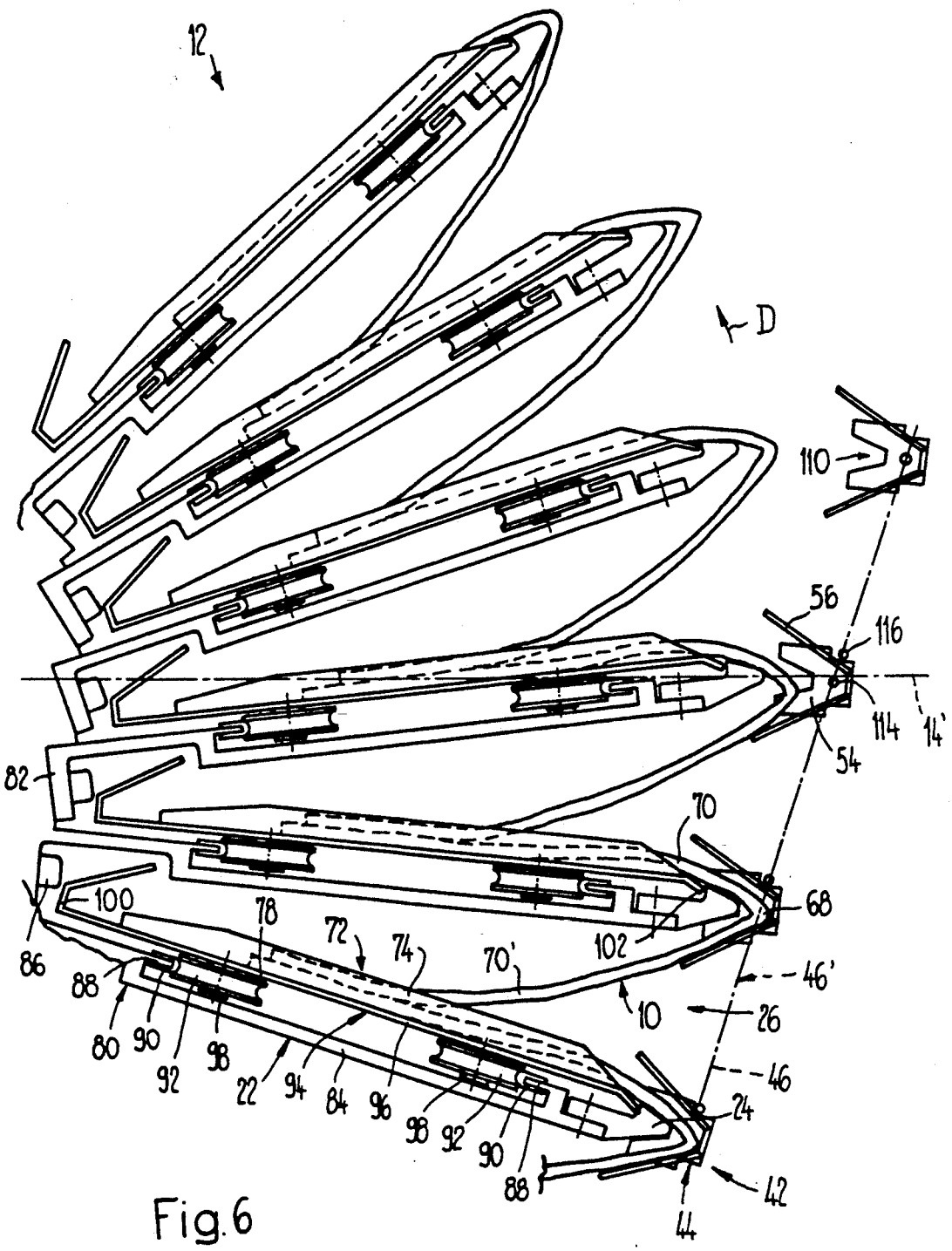
FIG. 6 shows, simplified, a part of the processing drum in the region where the holding elements separate from the rests and the advancement of the printing products begins.

FIG. 6 shows a part of the processing drum 12 in the region where the holding means 42 run off the rests 24. Each rest 24 has a printing product 10 reaching around it, the respectively leading printing product part 70 bearing against the carriage 94 forming the front wall 78 of the wall element 22 concerned, and the printing product part 70' following this rest 24 being spread away from the wall element 22, on account of its flexibility, and bearing against the printing product part 70 of the printing product 10 located on the following rest 24. According to FIG. 3, the working stroke of the advancing means 72 begins as soon as the holding means 42 run off the rests 24. This takes place at approximately the height of the axis 14, which is indicated in FIG. 6 by the dot-dashed line 14'. Since the advancing means 72 assigned to a wall element 22 begin the working stroke in each case at a time before the advancing means 72 assigned to the next-following wall element 22, the printing products 10 lying on successive rests 24 are offset in a staircase-like manner in the direction of advancement V in that region of the circulating path of the rests 24 in which a working stroke is performed.

Figure 8:
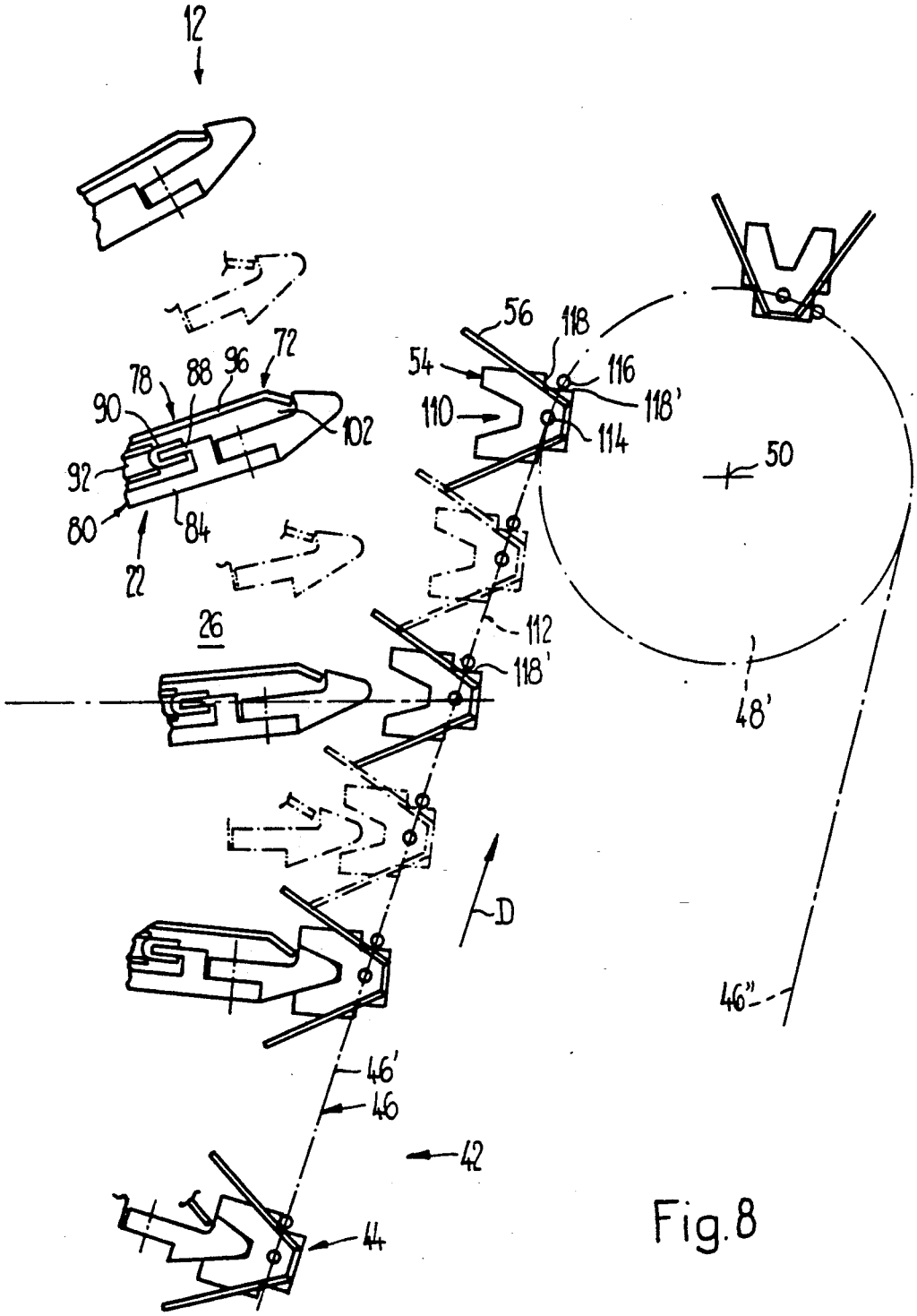
Figure 10:
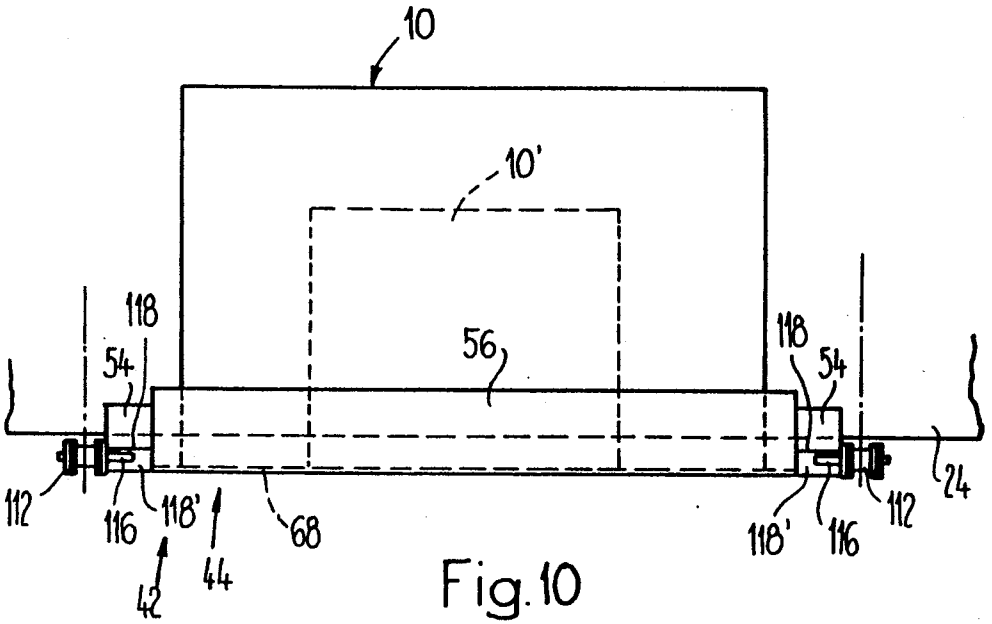
FIG. 10 shows a view in the direction of the arrow X of FIG. 9.
Figure 9:
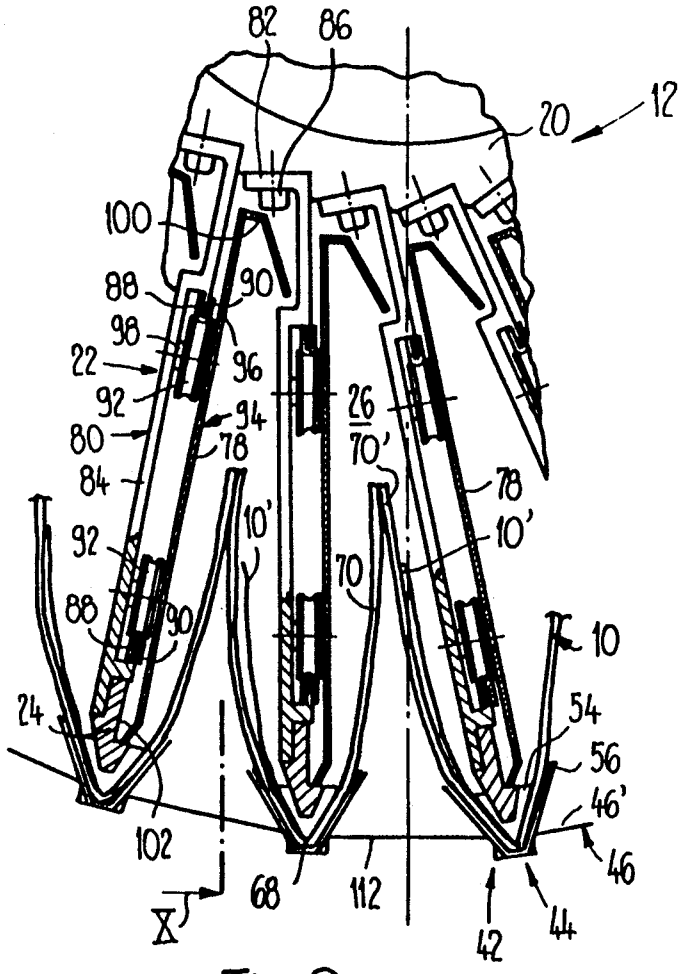
FIG. 9 shows, partially in section and enlarged, a part of the processing drum designated by the arrow IX in FIG. 2.

FIGS. 9 and 10 show the preferred embodiment of a holding member 44. The cross-sectionally approximately V-shaped holding element 56 extends along the rest 24 and projects at both ends beyond the printing product 10 to be prevented from falling down. Fastened at each of both its ends is a supporting element 54, which has on its side facing the rest 24 an approximately U-shaped or V-shaped recess 110, which is shaped approximately diametrically opposed to the shape of the rest 24. In the present case, the drawing member 46 has two endless chains 112, which run parallel to each other, spaced apart by the length of a holding member 44, and from which there protrude pins 114, which reach into one supporting element 54 each (see FIGS. 7, 8). The holding members 44 are pivotable about these pins 114.

The supporting elements 54 reaching around the rests 24 ensure a predetermined spacing between the holding elements 56 and the rests 24, in order to prevent damage to the printing products 10. The holding elements 56 support the printing products 10 in the region adjoining the fold 68, so that said products cannot spread out to such an extent that they can protrude from the receiving part 26 in the lower region of the circulating path, compare in this respect FIG. 9. As FIGS. 9 and 10 show, non-folded printing products 10', introduced as supplements into the receiving parts 26, are also securely held in the receiving parts 26, since these printing products 10' in each case stand against the bottom element 100 when passing through the upper part of the path of movement and come to lie within the holding element 56 concerned when passing through the lower region of the circulating path. In order to hold the printing products 10 in bearing contact against the rests 24, the holding elements 56 may be mounted in a prestressed manner in the direction towards the rests 24 or have on their side facing the rests 24 a flexible covering, for example of foam rubber.

In order to restrict the pivoting angle of the holding members 44 with respect to the longitudinal direction of the chains 112, arranged on the chains 112 are stop pins 116, which interact with corresponding stop faces 118, 118, on the supporting elements 54.

Figure 7:
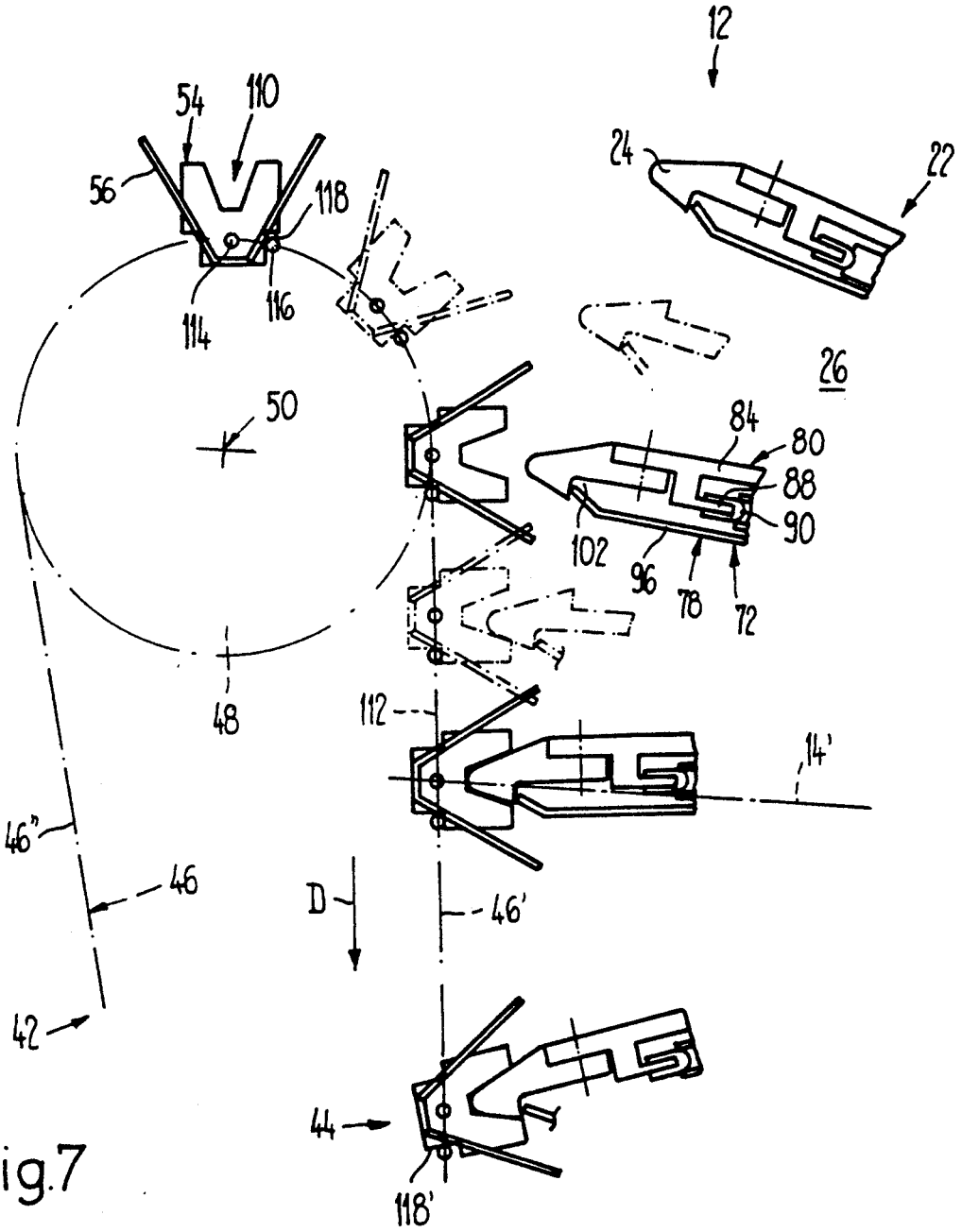
FIGS. 7 and 8 show the run-in and run-out region, respectively, of the holding elements.

FIG. 7 shows the running-in of the holding means 42 onto the processing drum 12 and FIG. 8 shows the running-off of these holding means 42 from the processing drum 12 step by step, the holding members 44 and wall elements 22 with rests 24 being indicated by solid lines in the working cycle and holding members 44 and rests 24 being indicated by dot-dashed lines midway between working cycles. When the supporting elements 54 run up against the rest 24 concerned, the stop pins 116, in interaction with the stop face 118, hold the holding members 44 in a position such that the recess 110 and the rests 24 are aligned with one another. During the course of the further rotation of the processing drum 12 in arrow direction D and the corresponding accompanying movement of the holding means 42, the holding members 44 are inclined slightly rearwardly, this being on account of the slightly forwardly inclined alignment of the wall elements 22 with respect to the axial plane concerned, as is indicated in FIG. 7 by way of the lowermost holding member 44. The position of this holding member 44 is thereby determined by the rest 24. Likewise, when the supporting elements 54 run off the rest 24 concerned, the stop pin 116 holds the supporting elements 54 in the position aligned with the rest 24, the stop pin 116 interacting with the stop face 118' of the supporting element 54 (FIG. 8).

As can be seen from FIGS. 1 and 2, the grippers 60 of each conveyor 58 circulate in a plane which runs at right angles to the axis 14 of the processing drum 12. These conveyors 58 have rectilinearly ahead of them unwinding stations 120, as are described for example in EP-A-0,281,790 or the corresponding US-A-4,898,336 and EP-A-0,298,267 or the corresponding US-A-4,995,563. Arranged on a vertical stand 122 is a bearing arrangement 124 for a roll 126. The roll 126 comprises printing products 10 wound up together with a tensioned winding band 128 in an imbricated formation on a winding core. An endless band 130 bears in an undershot manner against the roll 126 and directs the unwound printing products 10 to a belt conveyor 132. The unwinding stations 120 are virtually part of a twin unwinding station, since in each case two unwinding stations are provided next to each other back to back with, if appropriate, a common stand 120. There are in each case two unwinding stations 120 arranged one behind the other, which are alternately in use in order to ensure uninterrupted operation when the one unwinding station 120 has to be fitted with a new roll 126. The respective belt conveyors 132 convey the unwound printing products to a transferring device 134, as is known from EP-A-0,368,009 or the corresponding US-A-5,042,792. There, the printing products 10 are conveyed with the fold ahead against a stop and bent out upwards, so that in each case a gripper 60 can seize a printing product 10 in the region of its fold 68. The chains 64 on which the grippers 60 are arranged and sprocket wheels for the chains 64 of the conveyors 58 are indicated by dot-dashed lines.

It is to be noted that the two bearing arrangements 124 arranged on a single strand 122 are aligned in such a way with respect to the processing drum 12 that the printing products 10 concerned, conveyed in a plane, are in each case fed to two drum sections 34, between which there lies a further drum section 34. Two successive twin unwinding stations, seen in the longitudinal direction of the processing drum 12, are in each case spaced apart by the length of two drum sections 34, which in turn allows the feeding of the printing products in a plane, and at the same time permits the loading of the bearing arrangements 124 with rolls 126.

Likewise, the removal station 32 has a generally known gripper conveyor 140. The latter seizes the finished-processed printing products, resting on the rests 24, in the region of their fold 68 and conveys them away. In order to permit the seizing, the rests 24 have clearances 142 in the region of the drum section 34.7.

Conveying devices which are designed as belt conveyors and pass through underneath the processing drum 12, in order to be able to feed printing products 10 to the transferring device 134 independently of the unwinding stations 120 shown, are designated by 144. The device designated by 36 may have a generally known feeder 146, which in a known manner draws off in each case from a stack the lowermost product 10', which is fed via a belt conveyor 148 to the processing drum 12 and propelled into the receiving part 26.

The operating principle of the apparatus shown in FIG. 1 is as follows. The conveyor 58 of the first feed station 30, seen in direction of advancement V, feeds in the feed section 34.2 a printing product 10 to each rest 24, so that said printing product comes to lie in a straddling manner on the rest 24, as FIG. 2 shows. When the processing drum 12 rotates in the direction of rotation D, the deposited printing products 10 maintain their position with respect to the rests 24, until the advancing means 72 in each case perform a working stroke. This takes place in the rear upper quadrant, which cannot be seen in FIG. 1, of the processing drum 12. The printing products 10 thereby pass into the drum section 34.3 where no processing is performed. During the course of the next revolution, the printing products 10 are fed from this drum section 34.3 to the feed section 34.4, where a further printing product 10 is then deposited in a straddling manner on each printing product 10 by the corresponding conveyor 58. These two printing products 10, deposited one on top of the other, are then pushed during the course of three further revolutions of the processing drum 12 step by step to the feed section assigned to next-following feed station 30, wherein turn a further printing product 10 is deposited in a straddling manner upon them. The printing products 10 are in this way fed step by step during the course of each revolution to a following drum section 34, where a further processing of the printing products 10 can take place or not. When the finished-processed printing products 10 reach the feed section 34.7 at the end of the processing drum 12, the finished products are taken over by the gripper conveyor 140 and carried away.

If appropriate, supplements 10' are inserted page-appropriately into the printing products 10 by means of the device 36 and/or supplements are adhesively attached page-appropriately to the printing products 10 by means of devices 38. Thereafter, the collected printing products 10 can be stitched together by means of the stitching device 40. For the sake of completeness, it should be mentioned that, when passing through the lower part of the path of movement, the printing products 10 are in each case prevented from falling down by holding means 42.

Figure 11:
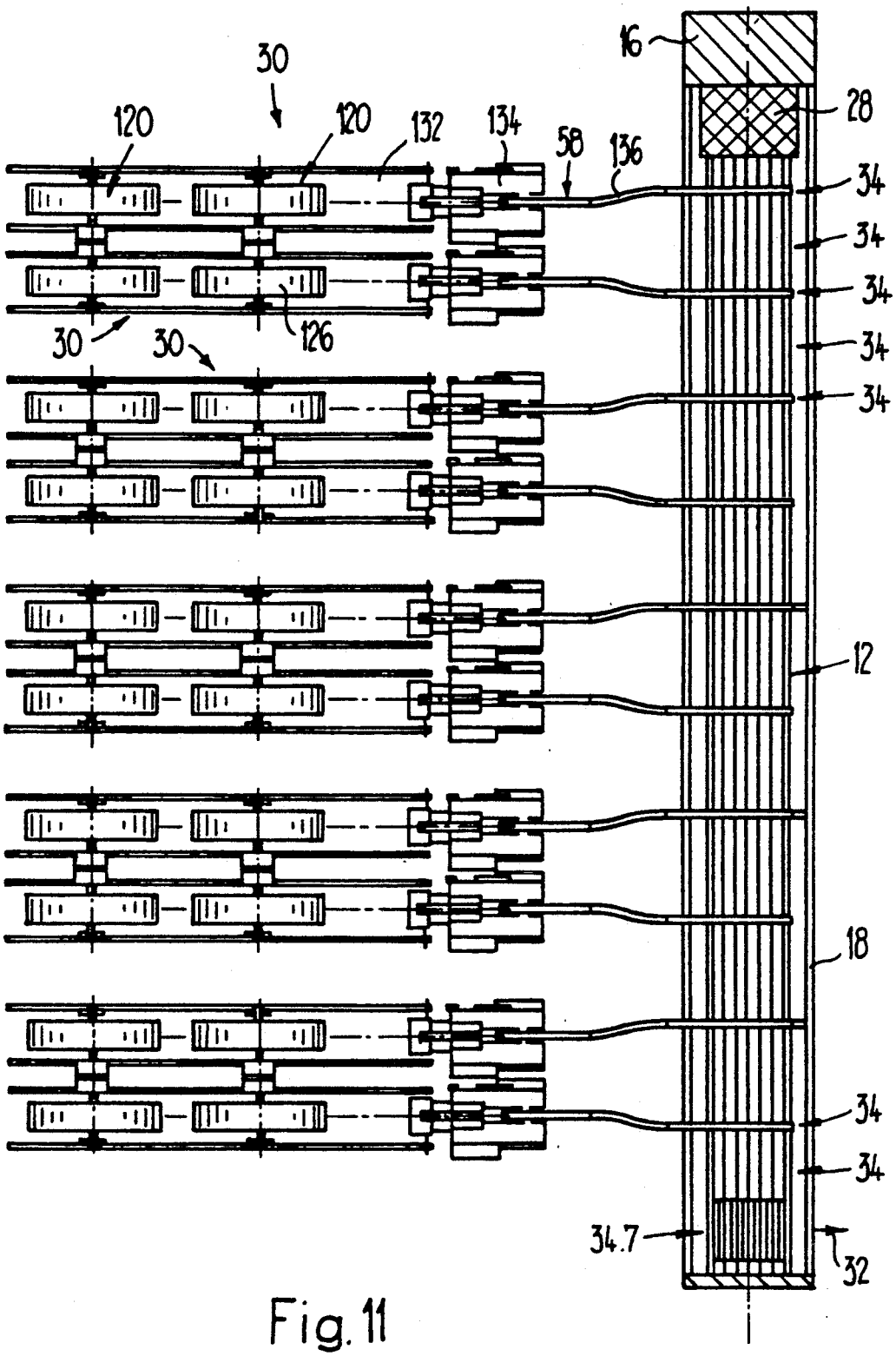
FIG. 11 shows, in plan view and simplified, a further embodiment of the apparatus according to the invention.

FIG. 11 shows a further embodiment of the apparatus according to the invention, similar to FIG. 1. The essential difference is that the path of movement 136 of the grippers of the conveyors 58 in each case run no longer exclusively in a plane, but are bent in an S-shaped manner in the middle region, in order to make it possible for there always to be between respectively successive drum sections 34 assigned to a feed station 30 (feed section) a single further drum section 34. In this figure, the drum sections of the processing drum 12 are only indicated by arrows provided with corresponding reference numerals 34.

The processing drum 12 is mounted freely rotatably on the machine frame 18 and driven in a continuously rotating manner by means of the diagrammatically shown drive motor 16. The drive mechanism 28 for the advancing means, not shown in this figure, is also only indicated symbolically, as is the removal station 32.

Each feed station 30 has two unwinding stations 120, arranged one behind the other, the unwound printing products 10 being fed via belt conveyors 132 to the transferring device 134 as described further above in conjunction with FIG. 1. From said transferring device, the printing products 10 are taken over individually by the grippers 60 of the conveyor 58 and fed to the feed section 34 concerned. The unwinding stations 120 of in each case two neighboring feed stations 30 are arranged back to back, so that an aisle remains clear between unwinding stations 120 respectively standing in pairs next to each other, in order to fit the unwinding stations 120 on both sides of this aisle with rolls 126. This differing distance between the unwinding stations 120 is compensated by the path of movement 136 of the grippers, running in an S-shaped manner in plan view. Otherwise, the operating principle of the apparatus shown in this FIG. 11 is the same as the apparatus shown in FIG. 1 and described further above.

It is of course also conceivable to assign a removal station not only to the drum section 34.7, but also to another drum section 34. In this case, various finished products can be produced with the same processing apparatus.

It is also possible to provide instead of the gripper conveyor 140 of the removal station 32 a belt conveyor, onto which the finished products fall from the rests 24 on account of their own weight. If printing products which either contain loose supplements or which have gathered printing products are to be carried away by means of a gripper conveyor, it is also conceivable for the gripper conveyor to seize the finished printing products 10 underneath the processing drum 12. In principle, it is possible for the removal station to be able to take over the collected printing products 10 at any desired point, seen in the circumferential direction.

It is of course also conceivable to support the holding members 44 assigned to neighboring drum sections 34 on a chain 64. Furthermore, the drawing members 46 or chains 64 may be guided in rails, in order to hold the supporting elements 54 in bearing contact on the rests 24 and to support the processing drum 12. In this case, the drawing members 46 may be designed to be flexible.

A holding element may also extend over two or more drum sections 34 and have a supporting element at each of its ends.

Since the present invention makes it possible to design the processing drum 12 to be very long and with a small diameter, it is also advantageous to drive it at both ends. Thus, it is also conceivable to drive the drawing members 46 such that, by means of the engagement of the supporting elements 54 and rests 24, they drive the processing drum 12.

The processing drum may also be supported between the holding means 42, for example by means of separate chains and supporting elements.

As can be seen in particular from FIG. 2, the holding means 42 reach around the processing drum 12 not only in the lowermost section of the lower part of the circulating path, in which the rests 24 and folds 68 of the printing products 10 are downwardly directed, but on both sides further upward beyond this section. This allows a greater speed of the processing drum 12, it being quite conceivable for the beginning of the conveying stroke still to begin, as long as the printing products 10 and rests 24 are enclosed by the holding element 56 concerned. It should be ensured here, however, that the printing products 10 do not collide with supporting elements 54. In any case, however, in said section of the circulating path, in which the printing products 10 are prevented from falling off the processing drum 12 by the holding means 42 alone and not by friction with the wall elements 22 and rests 24, no conveyance in the axial direction takes place.

We claim:

1. A process for processing printing products, comprising the steps in which folded printing products are deposited in at least one feed section of a processing drum driven rotationally about an approximately horizontal axis, in a straddling manner on saddle-shaped rests of said drum, which rests are distributed regularly in the circumferential direction and run approximately parallel to the axis, and are then transported in a transporting direction during the course of revolutions of the processing drum step by step along the rests to a removal section of the processing drum and, when passing through a section of the lower part of the circulating path about the axis, in which section the fold of the printing products is directed essentially downward, are prevented from falling off the processing drum, wherein the printing products are advanced in the upper part of the circulating path by at least one part of a step in each case by pushing against their trailing edges, as seen in the transporting direction, and the printing products whose advancement in the direction of the axis is held at a standstill in the lower part of the circulating path in said section are exclusively prevented from falling off the rests by endless holding means which are arranged underneath the processing drum and move with the rests.

2. An apparatus for processing printing products comprising: a processing drum driven rotationally about an approximately horizontal axis and having saddle-shaped rests which are distributed regularly in the circumferential direction, run approximately parallel to the axis and are arranged on approximately radial wall elements, the drum having at least one feed section, in which folded printing products can be deposited in a straddling manner on the rests, having a removal section, which is offset with respect to said feed section in the direction of the axis and in which the processed printing products can be carried away from the processing drum, and having transport means for the step-by-step transport of the printing products from the feed section to the removal section, the transport means performing a working stroke during the course of a revolution of the processing drum in the direction from the feed section toward the removal section and a return stroke in the opposite direction, wherein the transport means are formed by advancing means which act on the printing products exclusively in a pushing manner and, as seen in the direction of the working stroke, on the trailing edges of said products, perform at least a part of the working stroke in each case in an upper region of the circulating path and are advancing-inactive in a section of the circulating path in which the rests are directed essentially downward, and wherein underneath the processing drum there are arranged endless holding means which, at least in said section of the circulating path, reach around the processing drum and move synchronously with the rest to prevent the printing products from falling off the processing drum in the section in which the rests are directed essentially downward.

3. The apparatus as claimed in claim 2, wherein the advancing means have sliding cams which are assigned to each wall element, project beyond the latter in a receiving part bounded by said wall element and a neighboring wall element, are spaced apart in the axial direction by a working stroke and are preferably designed as driving fillets.

4. The apparatus as claimed in claim 3, wherein the wall elements have profile-like guide members running in the direction of the axis, on which members the advancing means are guided in the manner of a carriage or slide.

5. The apparatus as claimed in claim 4, wherein the advancing means have carriages which are mounted on the guide members, preferably form in each case the front wall of the wall element concerned and on which the sliding cams or driving fillets are arranged.

6. The apparatus as claimed in claim 5, wherein the carriages have a bottom element which is preferably designed in the manner of a channel and inwardly bounds the receiving part concerned in the radial direction.

7. The apparatus as claimed in claim 2, wherein the advancing means assigned to a wall element reach into the receiving part bounded, as seen in the direction of rotation of the processing drum, in each case by the latter and the neighboring preceding wall element, and perform a working stroke within a region of the circulating path of the rest concerned, following the section of the lower part of the circulating path and ending approximately vertically above the axis, and perform a return stroke within a further region of the circulating path following said first region and ending approximately vertically below the axis.

8. The apparatus as claimed in claim 2, wherein the . advancing means are driven by means of a drive mechanism which has a stationary slotted-link arrangement which is preferably arranged outside the processing drum and in which a following member of the advancing means respectively assigned to a wall element is guided.

9. The apparatus as claimed in claim 8, wherein the position of the drive mechanism can be set with respect to the processing drum in the direction of the axis.

10. The apparatus as claimed in claim 8, wherein the connection between the advancing means assigned to a rest and the drive mechanism is releasable in a controlled manner, or the slotted-link arrangement has a secondary branch into which the following members can be made to enter individually, in order to hold the advancing means concerned firmly in the direction of the axis during a revolution of the processing drum.

11. The apparatus as claimed in claim 2, wherein the holding means have holding elements which are preferably cross-sectionally V-shaped, extend at least approximately over the length of a drum section, reach around the rests at a distance and are fastened on endless drawing members led around deflection wheels mounted rotatably parallel to the axis.

12. The apparatus as claimed in claim 11, wherein a supporting element shaped approximately diametrically opposed to the rests and connected to the drawing members concerned is arranged at both ends on each holding element, and the supporting elements engage with the rests outside the printing products.

13. The apparatus as claimed in claim 12, wherein the drawing members are essentially inflexible, in order to support the processing drum by means of the supporting elements.

14. The apparatus as claimed in claim 12, wherein the supporting elements are strictly pivotable with respect to the drawing members.

15. The apparatus as claimed in claim 2, wherein the processing drum has a plurality of feed sections and between successive feed sections there is provided at least one further drum section.

16. The apparatus as claimed in claim 15, wherein the feed sections are assigned feed stations which have conveyors which are provided with grippers and circulate in planes running approximately parallel to one another and transverse to the axis, and wherein the supply conveyors preferably have rectilinearly ahead of them unwinding stations for unwinding the printing products wound up together with a winding band to form a roll.

17. The apparatus as claimed in claim 15, wherein drum sections in each case between two feed sections or the feed sections and the removal section are further assigned processing stations, preferably supplement feeding devices, supplement adhesively-attaching devices or stitching devices.

18. The apparatus as claimed in claim 2, wherein the removal section is assigned a removal station with a removal conveyor, which takes over the printing products at any desired point, as seen in the circumferential direction of the processing drum.

* * * * *